US008371869B2

(12) United States Patent
Shigihara

(10) Patent No.: US 8,371,869 B2
(45) Date of Patent: Feb. 12, 2013

(54) MINUTE CONNECTOR

(75) Inventor: Masayoshi Shigihara, Tokyo (JP)

(73) Assignee: SMK Corporation, Tokyo (JP)

( * ) Notice: Subject to any disclaimer, the term of this patent is extended or adjusted under 35 U.S.C. 154(b) by 291 days.

(21) Appl. No.: 12/838,426

(22) Filed: Jul. 16, 2010

(65) Prior Publication Data

US 2011/0053393 A1 Mar. 3, 2011

(30) Foreign Application Priority Data

Aug. 31, 2009 (JP) ..... 2009-200357

(51) Int. Cl.
*H01R 13/28* (2006.01)

(52) U.S. Cl. ..... 439/290; 439/930

(58) Field of Classification Search ..... 439/930, 439/285, 290, 291, 87, 91, 86, 374
See application file for complete search history.

(56) References Cited

U.S. PATENT DOCUMENTS 4,241,970 A * 12/1980 Rider et al. ..... 439/856
6,994,578 B1 * 2/2006 Chen ..... 439/284
7,427,202 B2 * 9/2008 Schamberger et al. ..... 439/66
7,699,635 B2 * 4/2010 Weaver et al. ..... 439/930

FOREIGN PATENT DOCUMENTS

JP 2007-287375 A 11/2007
JP 2009-007461 A 1/2009

* cited by examiner

*Primary Examiner* — Felix O Figueroa
(74) *Attorney, Agent, or Firm* — Chen Yoshimura LLP

(57) ABSTRACT

A minute connector with a first connecting member and a second connecting member. The first connecting member has a first conductive portion disposed at each of the bottom surface of a plurality of recessing portions set at an insulative first substrate connected to first ends, and first contacts made of first carbon nanotube bundles protruding from the surface of a first substrate at second ends. The second connecting member has second contacts made of second carbon nanotube bundles connected to second conductive portions disposed at each of the bottom surface of recessing portions set at an insulative second substrate corresponding to each of the first contacts at first ends. Each of the first carbon nanotubes contacts between the second carbon nanotubes with each other in an overlapping manner at the state that the first contacts are contacted with each of the corresponding second contacts.

9 Claims, 10 Drawing Sheets

MINUTE CONNECTOR

CROSS REFERENCE TO RELATED APPLICATION

The contents of the following Japanese patent application is incorporated herein by reference, No. 2009-200357 filed on Aug. 31, 2009.

BACKGROUND

1. Technical Field

The present invention relates to a minute connector having minute contact structure.

2. Description of the Related Art

The contacts of most of the current connectors are fabricated by the press piercing of a plate that uses the spring material. It is thought that the lower limit of the size of the contact is about 0.2 mm under mechanical fabrication. On the other hand, in the connection interface structure of the semiconductor equipment, the structure of 0.1 mm or less has already been realized. The connection interface of the semiconductor equipment is, however, not aimed to repeat steady detaching.

In recent years, the miniaturization of connectors has been accelerated in accordance with the miniaturization of electronics devices. Minute contacting portions with the size and the pitch being disposed of 0.2 mm or less are required in accordance with the miniaturization of the connectors. In the case of forming such contacting portions, it is difficult to precisely fabricate under machine work around the lower limit of the fabricating preciseness. Furthermore, the manufacturing yield decreases and the manufacturing cost increases.

As a method of forming a minute contacting portions, metallic pattern formation technique by electroforming method or electroplating method, or the method of forming the conductive pattern using minute conducting particles or the like are known. In the contact formed by the methods mentioned above, the oxide film will be formed on the surface and the surface becomes uneven. In order to steadily obtain the connection with a low contacting resistance, it is required to destroy the oxide film by making the contacts slide mutually under pressure and to increase the contacting area between the contacts by applying a certain load.

In a minute contact being made of the metallic pattern or the conductive pattern, however, it is difficult to secure the elasticity modulus and to obtain the steady contact between the contacts. Moreover, increasing of the pressing force to secure the contact of the contacting portions causes the problems of the minute transformation by abrasion of the surfaces of the contacts or the short-circuit by abrasion powder or the like. In this way, it is questionable to apply pressure with the load or the like to minute contacting portions.

Connectors being formed with carbon nanotubes (CNT) having excellent abrasion tolerance and high electric conductivity orienting in the direction of the thickness of a substrate and using the CNT as contacts are reported (refer to Japanese Patent Application Publication Nos. 2009-7461 and 2007-287375). In order to secure the contact of the contacting portions, the end portions of CNT bundles that are composed of a plurality of CNT's are protruded from the opening edge of the substrate. If the CNT bundles are made contacted with metal electrodes by pressing, the CNT bundles will be dispersed. In this case, because a part of CNT's is dispersed outside or buckled, there is a possibility that the contact with the adjacent contacts or the like will be caused. This might prevent the pitch from being narrowed.

SUMMARY

In accordance with the first aspect of the present invention, a minute connector for connecting between an insulative first substrate and an insulative second substrate is provided.

(a) The insulative first substrate is provided with a plurality of first depressed portions and a first conductive portion is disposed at each of their bottom surfaces. The insulative second substrate is provided with a plurality of second depressed portions and a second conductive portion is disposed at each of their bottom surfaces.

The connector is provided with (b) a first connecting member having the plurality of first contacts corresponding to the plurality of first depressed portions, the first contacts being made of the plurality of first carbon nanotube bundles respectively connected to the first conductive portions at their first ends and protruding from the surface of the first substrate at their second ends and (c) a second connecting member having a plurality of second contacts corresponding to the plurality of second depressed portions, the second contacts being made of a plurality of second carbon nanotube bundles respectively connected to the second conductive portions at their first ends.

(d) Since the second ends of the plurality of first carbon nanotubes are inserted between second ends of the plurality of second carbon nanotubes so as to contact with each other in an overlapping manner, the plurality of first contacts each contact a corresponding one of the plurality of second contacts.

In accordance with the second aspect of the present invention, a minute connector for connecting between an insulative first substrate and an insulative second substrate is provided.

(a) The insulative first substrate is provided with a plurality of first depressed portions and a plurality of first conductive portions are disposed at each of the bottom surfaces. The insulative second substrate is provided with a plurality of second depressed portions and a plurality of second conductive portions are disposed at each of the bottom surfaces.

The connector is provided with (b) a first connecting member having a plurality of first contacts corresponding to a plurality of first depressed portions, the first contacts being made of the plurality of first carbon nanotube bundles respectively connected to the first conductive portions at their first ends and protruding from the surface of the first substrate at their second ends, and (c) a second connecting member having a plurality of second contacts corresponding to a plurality of second depressed portions, the second contacts being made of the plurality of second carbon nanotube bundles respectively connected to the second conductive portions at their first ends.

(d) An area density of the plurality of first carbon nanotubes differs from that of the plurality of second carbon nanotubes.

Since the second ends of either the plurality of first carbon nanotubes or the plurality of second carbon nanotubes having a higher area density are inserted into gaps between the second ends of the other carbon nanotubes with a lower area density so that the carbon nanotubes with the lower area density overlap with portions of the carbon nanotubes with the higher area density, a plurality of first contacts each contact a corresponding one of a plurality of second contacts.

In accordance with the present invention, a minute connector that is steadily and repeatedly connectable and possible to be miniaturized can be presented. The summary clause does not necessarily describe all necessary features of the embodiments of the present invention.

DESCRIPTION OF EXEMPLARY EMBODIMENTS

Hereinafter, embodiments of the present invention are explained referring to the figures. In the description of the following drawings, the same or a similar symbol is allocated to the same or a similar portion. The drawings are schematic, however, it should be noted that the relationship between the thickness and the plane dimension, the thickness ratio of each layer or the like are different from those of real ones. Therefore, the specific thickness or dimension has to be judged taking the following explanations into consideration. It goes without saying that the mutual dimensional relationship or the ratio is in part different from each other among figures.

The embodiments of the present invention shown hereinafter are to illustrate the devices or method to specify the technological ideas of the present invention, however, the technological ideas of the present invention does not limit the materials, forms, structures, design or the like to those mentioned below. The technological ideas of the present invention can be changed variously within the technological scope described in the claims.

Figure 1:
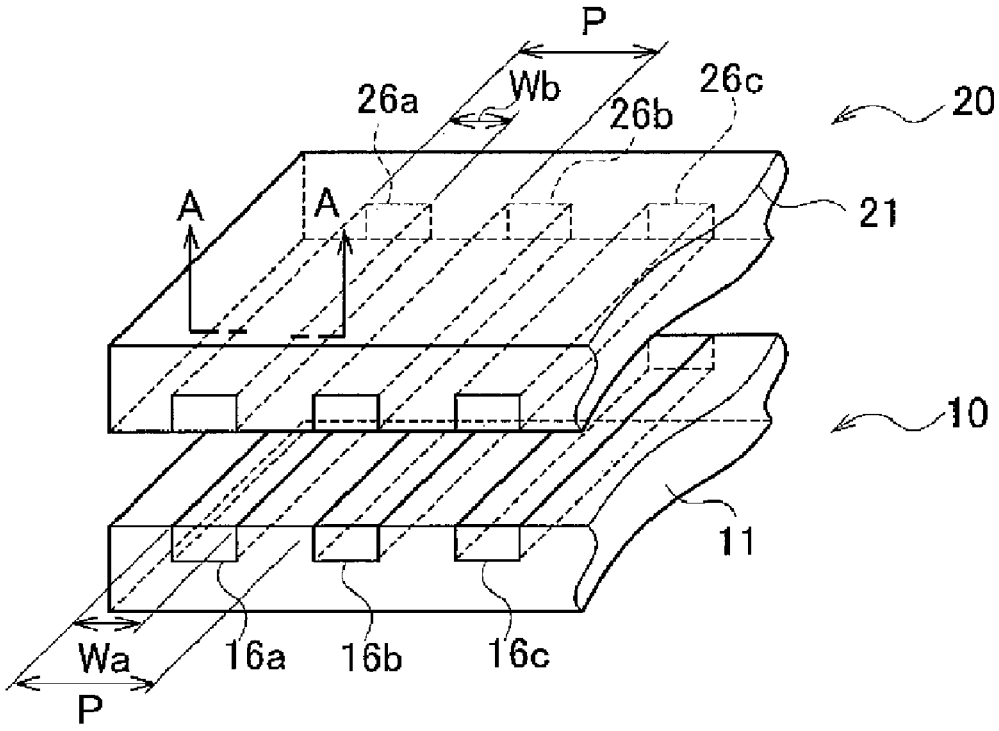
FIG. 1 shows an example of the perspective view of the minute connector in accordance with an embodiment of the present invention.

As it is shown in FIG. 1, the minute connector in accordance with an embodiment of the present invention is provided with a first connecting member 10 and a second connecting member 20. The first connecting member 10 is equipped with a first substrate 11 and a plurality of first contacts 16*a*, 16*b*, 16*c*, etc. that extend from one end to the other end of the first substrate. The first contacts 16*a*, 16*b*, 16*c* are arranged with the width Wa and the pitch P in the direction perpendicular to the extending direction of the first contacts 16*a*, 16*b*, 16*c*. The second connecting member 20 is equipped with a second substrate 21 and a plurality of second contacts 26*a*, 26*b*, 26*c*, etc. that extend from one end to the other end of the second substrate. The second contacts 26*a*, 26*b*, 26*c* are arranged with the width Wb and the pitch P in the direction perpendicular to the extending direction of the first contacts 16*a*, 16*b*, 16*c*.

The surface of the first contact 16*a* opposes to the surface of the second contact 26*a*. Similarly, each of the surface of the first contacts 16*b* and 16*c* opposes to each of the surface of the second contacts 26*b* and 26*c* respectively. When the first connecting member 10 and the second connecting member are put together, each of the first contacts 16*a*, 16*b* and 16*c* contacts each of the second contacts 26*a*, 26*b* and 26*c* respectively.

Figure 2:
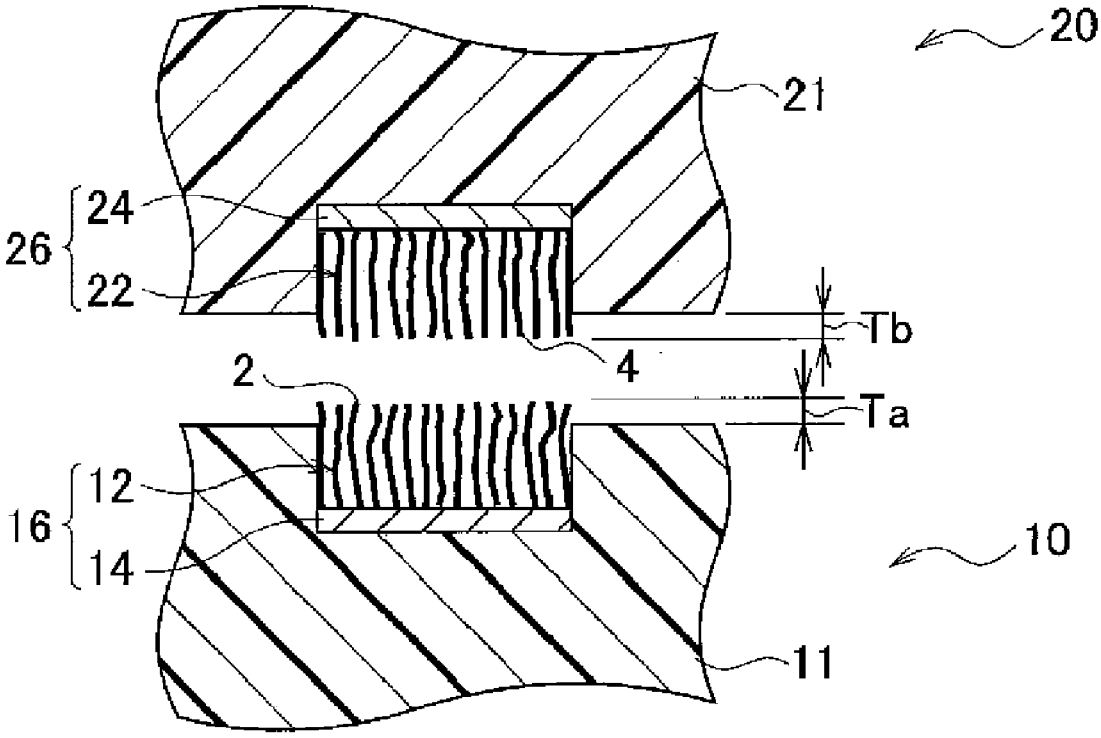
FIG. 2 shows a schematic view of the A-A cross section of the minute connector shown in FIG. 1.

As it is shown in FIG. 2, the first contact 16 of the first connecting member 10 is equipped with a first conductive portion 14 and a bundle 12 consisting of a plurality of first CNT 2 (hereinafter called CNT bundle). The first conductive portion 14 is disposed at the bottom surface of the recessed portion installed in the first substrate 11. The first ends of each of the plurality of the first CNT 2 are connected to the first conductive portion 14, and the second ends protrude from the level of the opening edge of the first substrate 11 with the height Ta.

Moreover, the second contact 26 of the second conductive member 20 is equipped with a second conductive portion 24 and a bundle 22 consisting of a plurality of second CNT 4 (hereinafter called CNT bundle). The second conductive portion 24 is disposed at the bottom surface of the recessed portion installed in the first substrate 21. The first ends of each of the plurality of the second CNT 4 are connected to the second conductive portion 24, and the second ends protrude from the level of the opening edge of the second substrate 21 with the height Tb.

The average diameters of the first CNT 2 and the second CNT 4, for example, are within the range from about 2 nm to about 10 nm respectively. The area density of the first CNT 2 with CNT bundle 12 and the second CNT 4 with CNT bundle 14 take the area density within the range from about $10^{11}$ $cm^{-2}$ to $10^{12}$ $cm^{-2}$ respectively. Metallic materials such as gold (Au), silver (Ag), copper (Cu), aluminum (Al) or the like are applied to the first conductive portion 14 and the second conductive portion 24. An insulative substrate made of plastics, ceramics or the like is applied to the first substrate 11 and the second substrate 12.

The CNT bundles 12 and 22 can be grown by an ordinary chemical vapor deposition (CVD) or the like. Such a metallic catalyst as cobalt (Co), iron (Fe), nickel (Ni) or the like is, for example, selectively formed on the semiconductor substrate of silicon (Si) or the like. CNT is grown vertically oriented on the semiconductor substrate by CVD using hydrocarbon gas. CNT grown up in this way is transferred to the surface of the first conductive portion 14 of the first substrate 11 and the surface of the second conductive portion 24 of the second substrate 21 to form CNT bundles 12, 22 respectively.

Figure 3:
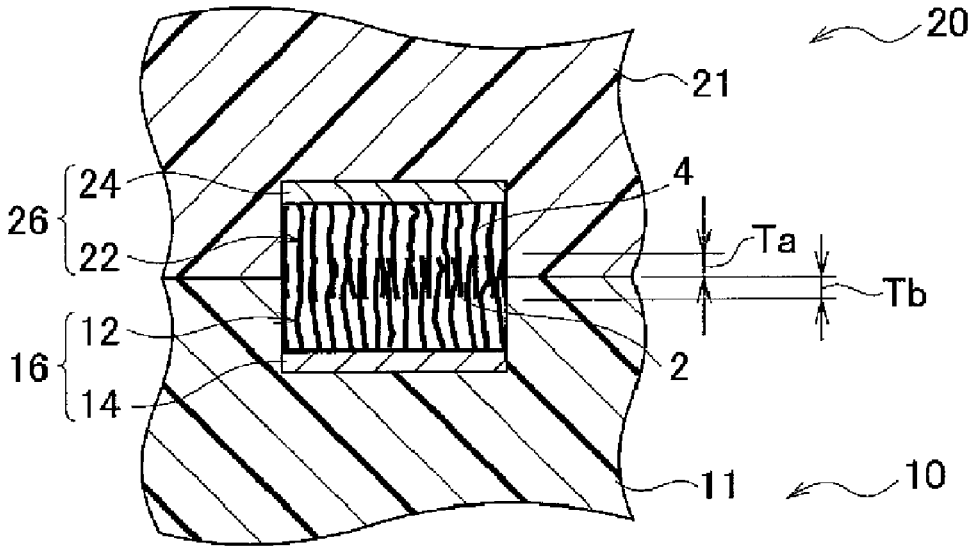
FIG. 3 shows an example of the cross-sectional schematic view of the contact of the minute connector in accordance with an embodiment of the present invention.

As it is shown in FIG. 3, the surfaces of the first substrate 11 and the second substrate 21 are mutually contacted so as the first contact 16 and the second contact 26 to contact each other. The first CNT 2 and the second CNT 4 contact so as the protruded portion with the height of Ta from the surface of the first substrate 11 and the protruded portion with the height of Tb from the surface of the second substrate 12 to enter into each other in an overlapping manner. No specific pressure is required to make the first contact 16 and the second contact 26 contact. Therefore, the stable connection between the first CNT 2 and the second CNT 4 is available repeatedly.

The width Wa of the first contact 16, the width Wb of the second contact 26 and the pitch P are not specifically restricted. Since the CNT bundle can be formed in a minute pattern, a contact with the width or the pitch, for example, of 0.2 mm or less, that is the precision limitation of the machine fabrication, can be formed. Moreover, since no specific pressure is required between the first contact 16 and the second contact 26, such problems as minute deformation due to the abrasion of the contacts, the short-circuit due to the abraded powder or the like will not occur. Therefore, the first contact 16 and the second contact 26 can be formed with the pitch P of 0.2 mm or less, the width Wa and Wb of 0.1 mm or less respectively.

Figure 4:
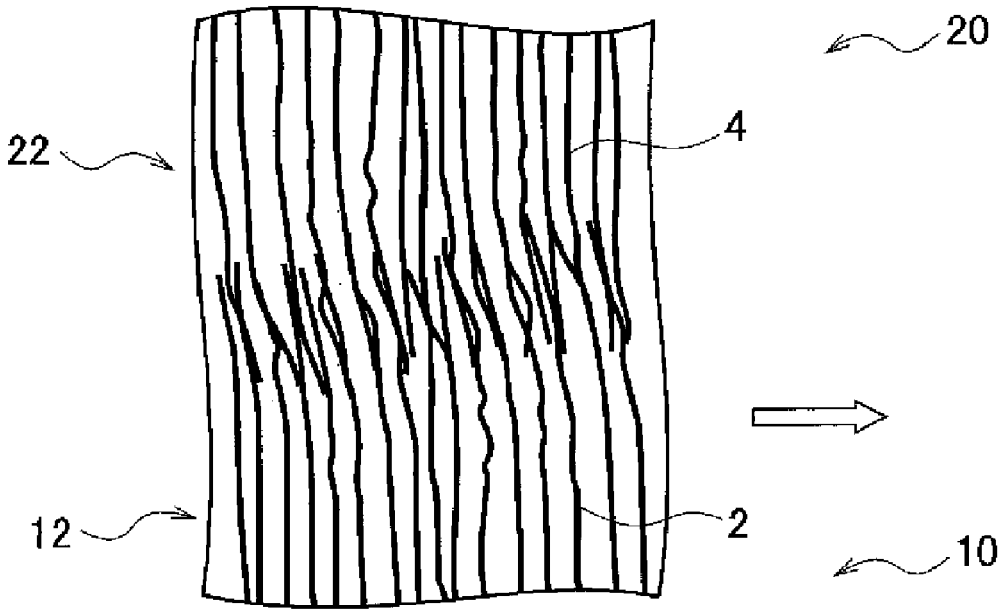
FIG. 4 shows a cross-sectional schematic view of the CNT contact of the minute connector in accordance with an embodiment of the present invention.

After bringing the first connecting member 10 into contact with the second connecting member 20 as it is shown in FIG. 3, the first connecting member 10 is allowed to slide to the arrow-marked direction in the FIG. 4 against the second connecting member 20, for example. Then, the overlapped parts of the first CNT 2 and the second CNT 4 are bent as shown in FIG. 4, further stable connection comes to be available.

Figure 5:
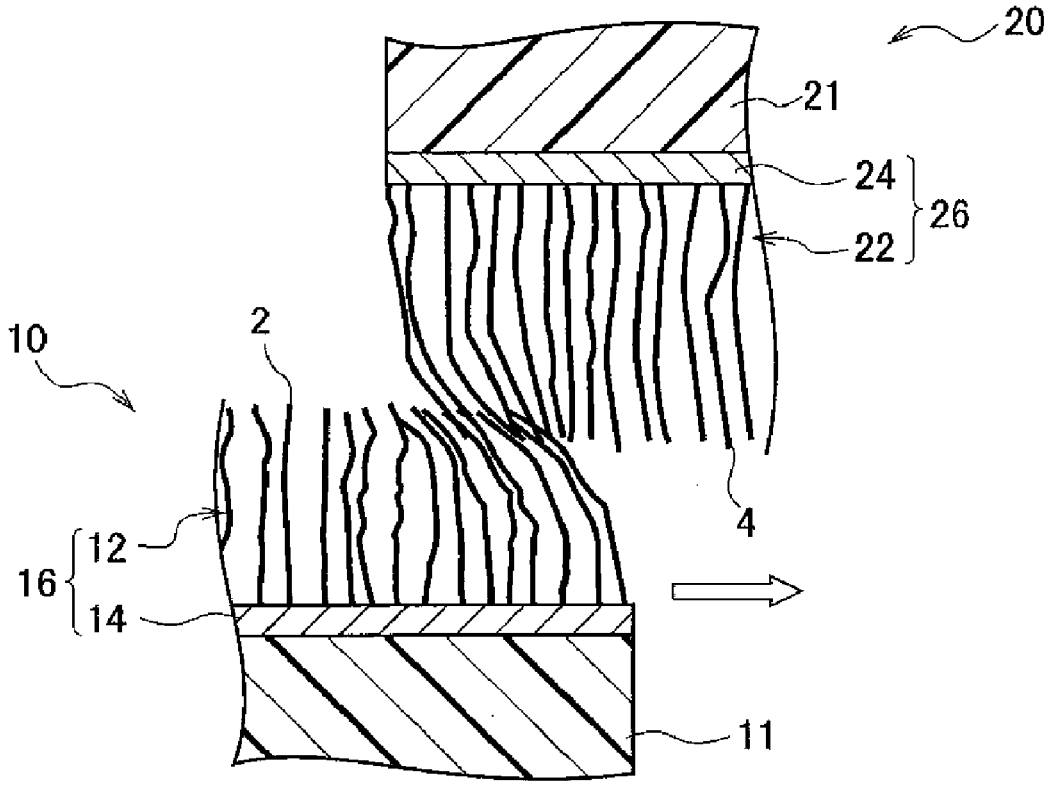
FIG. 5 shows an example of the cross-sectional schematic view of the slide of the minute connector in accordance with an embodiment of the present invention.

It is allowed to connect the first connecting member 10 with the second connecting member 20 by sliding. As it is shown in FIG. 5, the first connecting member 10 is allowed to slide to the arrow-marked direction against the second connecting member 20 after bringing one end of the first contact 16 into contact with the other end of the second contact 26 in the extending direction of the first contact 16 and the second contact 26. The plurality of the first CNT 2 of the first contact 16 and the plurality of the second CNT 4 of the second contact 26 come to contact in an overlapping manner with each other while the protruded portion from the first substrate 11 and the protruded portion from the second substrate 21 are being bent to the opposite direction by sliding. In this way, the first contact 16 and the second contact 26 can be contacted while the plurality of the first CNT 2 and the plurality of the second CNT 4 are being bent and overlapped by making the first connecting member 10 and the second connecting member 20 connect by sliding. In this reason, the connection between the first contact 16 and the second contact 26 can be executed steadily and repeatedly.

Figure 6:
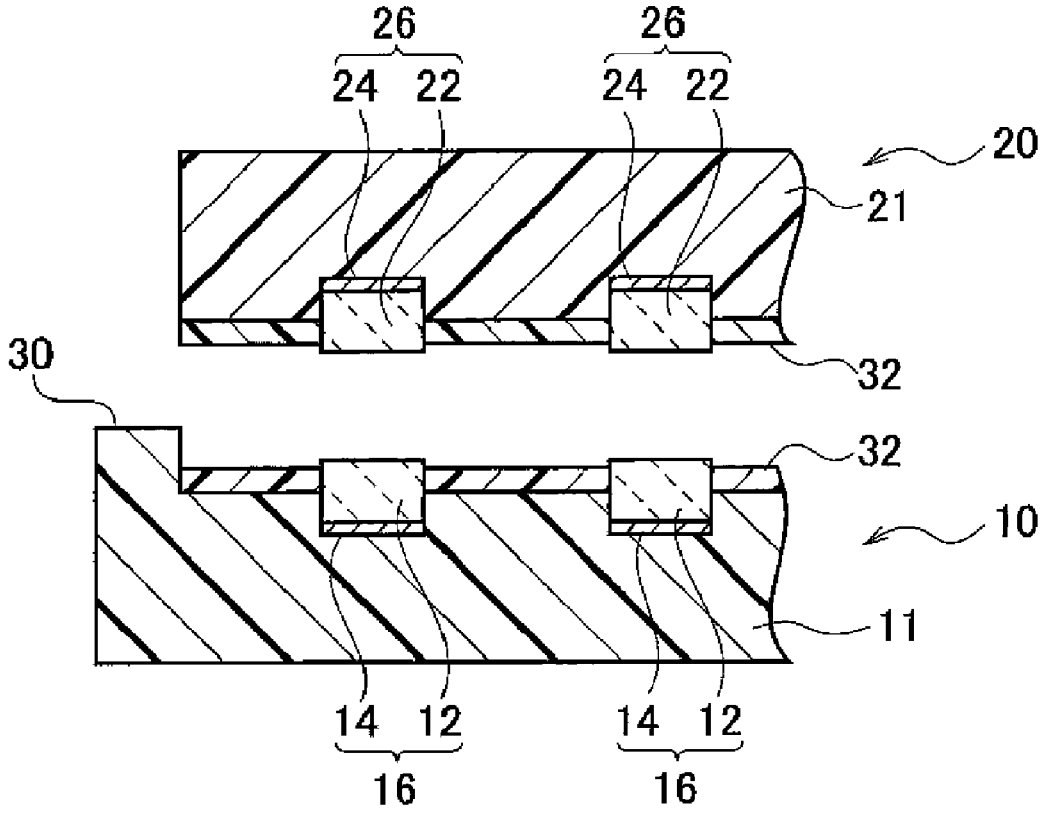
FIG. 6 shows first other example of the cross-sectional schematic view of the minute connector in accordance with an embodiment of the present invention.

In the case of executing the connection by sliding, it is desirable to form an insulative surface layers 32 of the abrasion coefficient, for example, of 0.5 or less on the surfaces of the first substrate 11 and the second substrate 21 respectively as it is shown in FIG. 6. Such resin material as fluororesin, nylon or the like is applied to the surface layer 32. The mechanical characteristics can be kept stable by setting the surface layer 32 with a small abrasion coefficient even the connection by sliding is executed repeatedly.

As shown in FIG. 6, a guide can be set parallel to the extending direction of the first contact 16 at the end portion of the first substrate 11 so as to slide the first substrate 11 while allowing the plurality of the first contacts 16 to contact with the plurality of the corresponding second contacts 26. The position of the plurality of the first contacts 16 can be adjusted with high precision to the position of the plurality of the corresponding second contact 26 using a guide 30, even though the first contact 16 and the second contact 26 of fine widths are arranged in a fine pitch.

Both of the first substrate 11 and the second substrate 21 are equipped with the surface layer 32, however, it is allowed that only one of the substrates is equipped with the surface layer 32. At least one of the first substrate 11 and the second substrate 21 is allowed to be an insulator with small abrasion coefficient. The guide 30 is set at the first substrate 11, however, it is allowed to set the guide 30 at the second substrate 21 instead. It is also allowed to set the guide 30 both at the first substrate 11 and the second substrate 21.

THE FIRST VARIATION EXAMPLE

Figure 7:
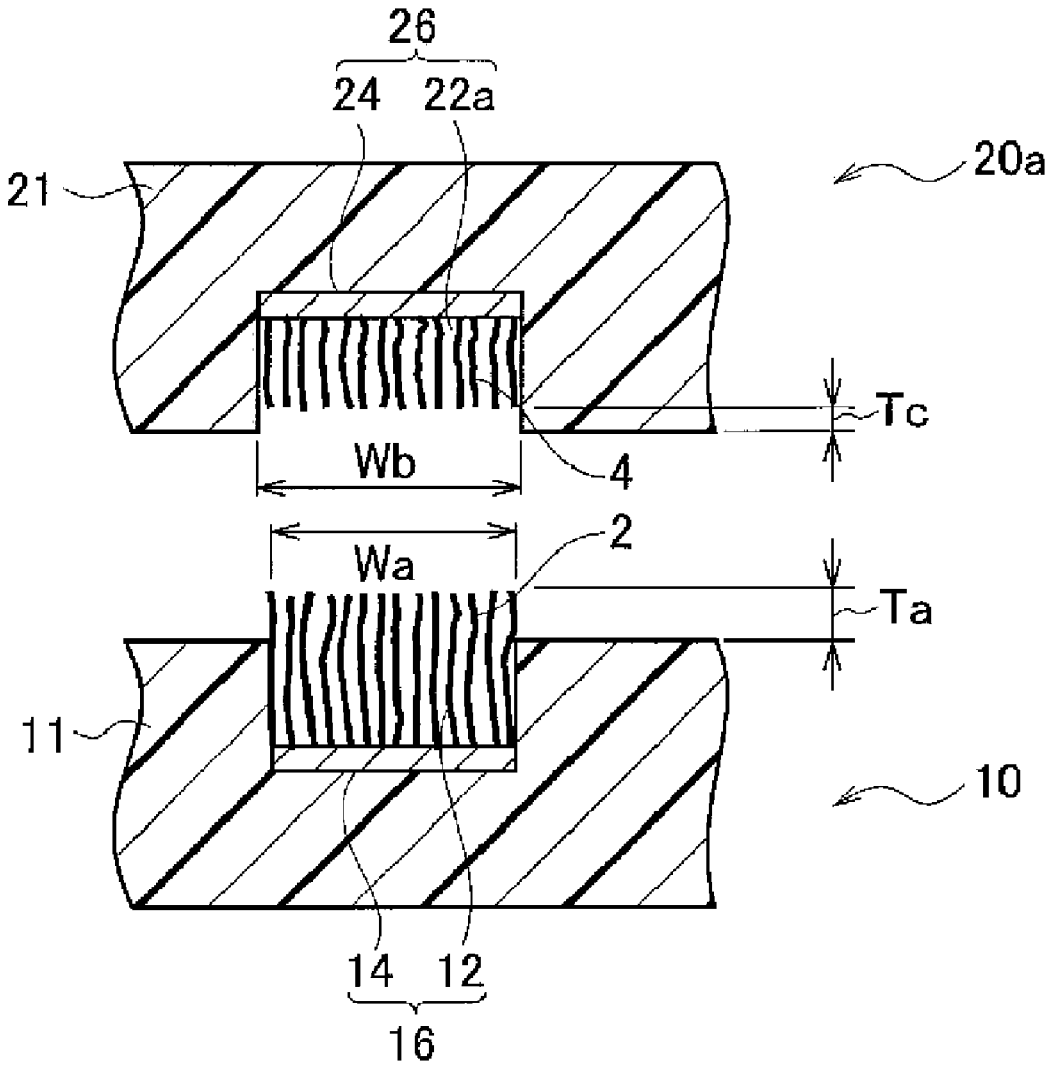
FIG. 7 shows second other example of the cross-sectional schematic view of the minute connector in accordance with an embodiment of the present invention.

The minute connector in accordance with the first variation example of the embodiment of the present invention is provided with the first connecting material 10 equipped with the first contact 16 and a second connecting material **20*a* equipped with the second contact 26, as it is shown in FIG. 7. The second contact 26 is equipped with a second conductive portion 24 and a CNT bundle 22*a* consisting of a plurality of second CNT 4. The first ends of the plurality of second CNT 4 are connected with the second conductive portion 24 that is disposed at the bottom surface of the recessed portion installed in the second substrate 21 respectively, and the second ends are positioned below the level of the opening edge of the second substrate 21** with the depth Tc.

In the first variation example of the embodiment, the point that the second ends of the plurality of second CNT 4 are positioned below the level of an opening edge of the second substrate 21 is different from the embodiment. Since the other constituents are the same as those of the embodiment, the overlapping description is omitted.

In the case that the first CNT 2 and the second CNT 4 protrude from the level of the opening edges of the first substrate 11 and the second substrate 21 respectively, as it is shown in FIG. 2 and FIG. 3, the first CNT 2 and the second CNT 4 at the respective outer circumference of the CNT bundle 12 and the CNT bundle **22*a* are liable to be dispersed and buckled on the occasion of contact. Once the first CNT 2 and the second CNT 4 are buckled, the outer circumference of the first CNT 2 and the second CNT 4** will get broken by repeating the sliding connection and it possibly causes the short circuit.

In the first variation example of the embodiment, the plurality of first CNT 2 protrude from the opening edges of the first substrate 11 with the height Ta, however, the plurality of second CNT 4 recess below the opening edge of the second substrate 21 to the recessed portion, as it is shown in FIG. 7. Here, the height Ta is to be larger than the depth Tc and the width Wa of the first contact 16 is to be equal to or less than the width Wb of the second contact 26. When the first contact 16 is contacted with the corresponding second contact 26, the protruding portion of the first CNT 2 is engaged with the recessed portion of the second substrate 21. Therefore, no buckling will occur in the first CNT 2, and the connection of the first connecting member 10 with the second connecting member **20*a*** can be executed steadily and repeatedly.

In the explanation mentioned above, the plurality of second CNT 4 are recessed from the opening edge of the second substrate 21. However, it is allowed to make the plurality of first CNT 2 recess from the opening edge of the first substrate 11 and to make the plurality of second CNT 4 protrude from the opening edge of the second substrate. In this case, the width Wa of the first contact 16 is equal to or larger than the width Wb of the second contact 26.

THE SECOND VARIATION EXAMPLE

Figure 8:
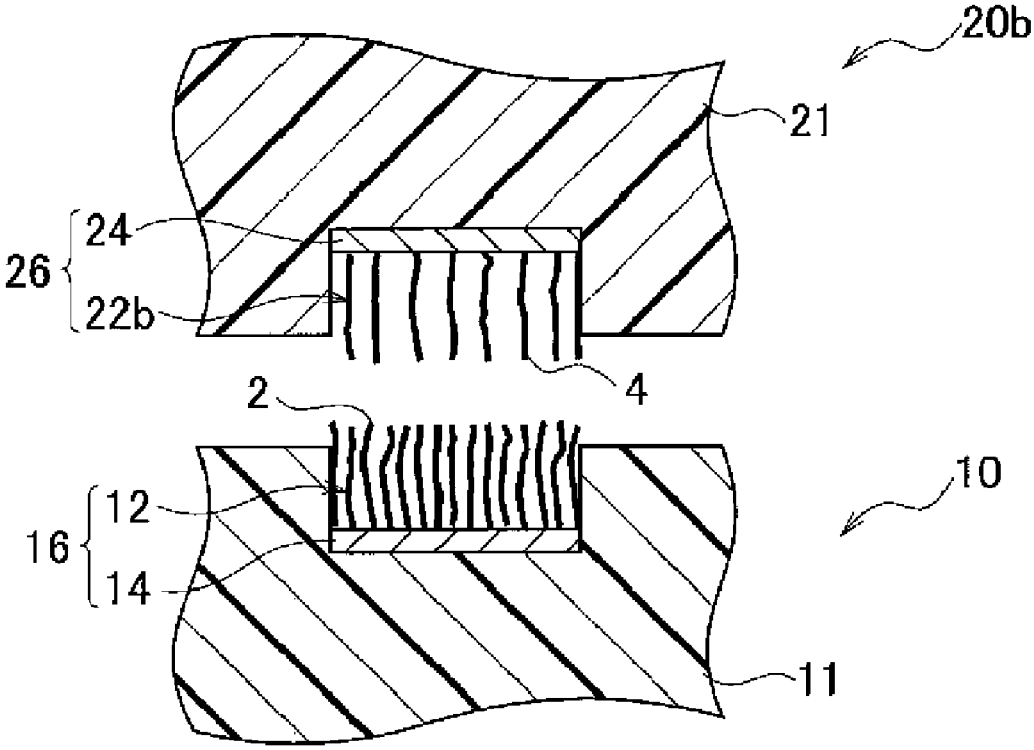
FIG. 8 shows third other example of the cross-sectional schematic view of the minute connector in accordance with an embodiment of the present invention.

The minute connector in accordance with the second variation example of the embodiment of the present invention is provided with the first connecting member 10 equipped with the first contact 16 and a second connecting member **20*b* equipped with the second contact 26, as it is shown in FIG. 8. The second contact 26 is equipped with a second conductive portion 24 and a CNT bundle 22*b* consisting of a plurality of second CNT 4. The area density of the plurality of second CNT 4 is smaller than the area density of the plurality of first CNT 2**.

In the second variation example of the embodiment, the point that the area density of the plurality of second CNT 4 is smaller than the area density of the first CNT 2 is different from the embodiment and the first variation example. Since the other constituents are the same as those of the embodiment and of the first variation example, the overlapping description is omitted.

Since the area density of the plurality of second CNT 4 is smaller than the area density of the plurality of first CNT 2, as it is shown in FIG. 8, it is easy to make the plurality of first CNT 2 overlap in the gap of the plurality of second CNT 4. As a result, the connection of the first connecting member 10 and the second connecting member 20*b* can be executed steadily and repeatedly.

In the explanation mentioned above, the area density of the plurality of second CNT 4 is smaller than the area density of the plurality of first CNT 2. However, it is allowed to make the area density of the plurality of second CNT 4 larger than the area density of the plurality of first CNT 2.

THE THIRD VARIATION EXAMPLE

Figure 9:
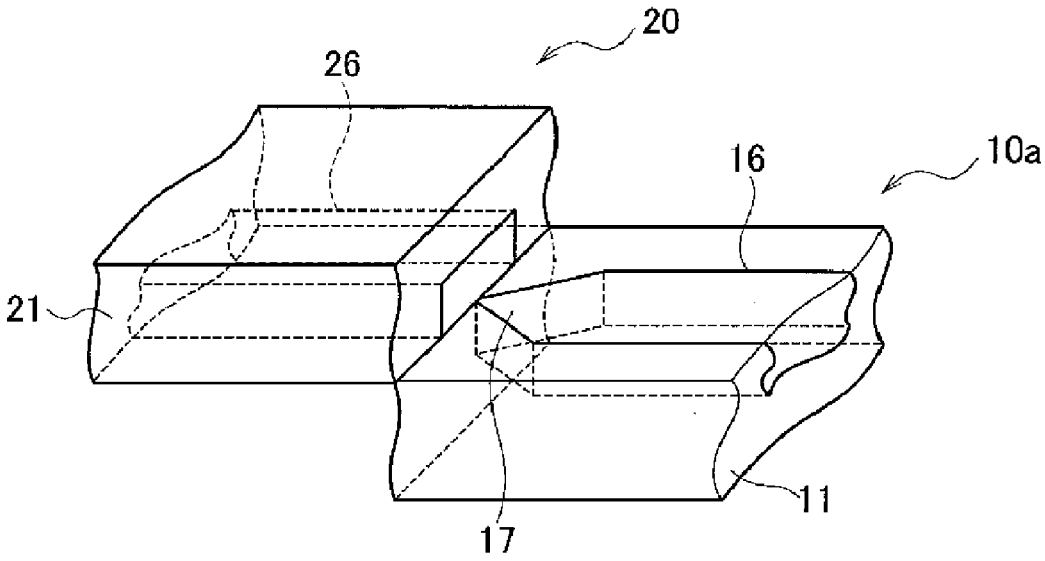
FIG. 9 shows another example of the plane schematic view of the minute connector in accordance with an embodiment of the present invention.

The minute connector in accordance with the third variation example of the embodiment of the present invention is provided with the first connecting member 10*a* equipped with the first contact 16 and a second connecting member 20 equipped with the second contact 26, as it is shown in FIG. 9. The first contact 16 is equipped with an end portion 17 having a shape of triangle at the first end of the first substrate 11.

In the third variation example of the embodiment, the point that the first contact 16 is equipped with a triangle end portion 17 is different from the embodiment, the first variation example, and the second variation example. Since the other constituents are the same as those of the embodiment, the first variation example and the second variation example, the overlapping description is omitted.

For example, the first contact 16 is allowed to contact with the second contact 26 by sliding the first connecting member 10*a* against the second connecting member 20, as it is shown in FIG. 9. In this case, the first connecting member 10 is slid while being contacted with the second contact 26 from the side of the end portion 17 of the first contact 16. Since the end of the end portion 17 is narrower than the width of the corresponding second contact 26, the contact between the first connecting member 16 and the second connecting member 26 from the sliding state to the fixed state can be executed steadily and repeatedly.

The shape of the end portion 17 is not necessarily limited to the triangle. Since the shape of the end portion 17 is to set a gradient in order to get a stable deformation during the sliding insertion, the shape is allowed, for example, to be trapezoidal or stepwise. It is also allowed to take a shape that becomes thinner with curvature toward the end.

(Other Embodiments)

The present invention has been hereinbefore explained using embodiments, however, the description or the drawings that are a part of this disclosure shall not be deemed to limit the invention. Through this disclosure, forms of various substitution embodiments, embodiment examples and applied technologies will be well known in the persons skilled in the art.

Figure 10:
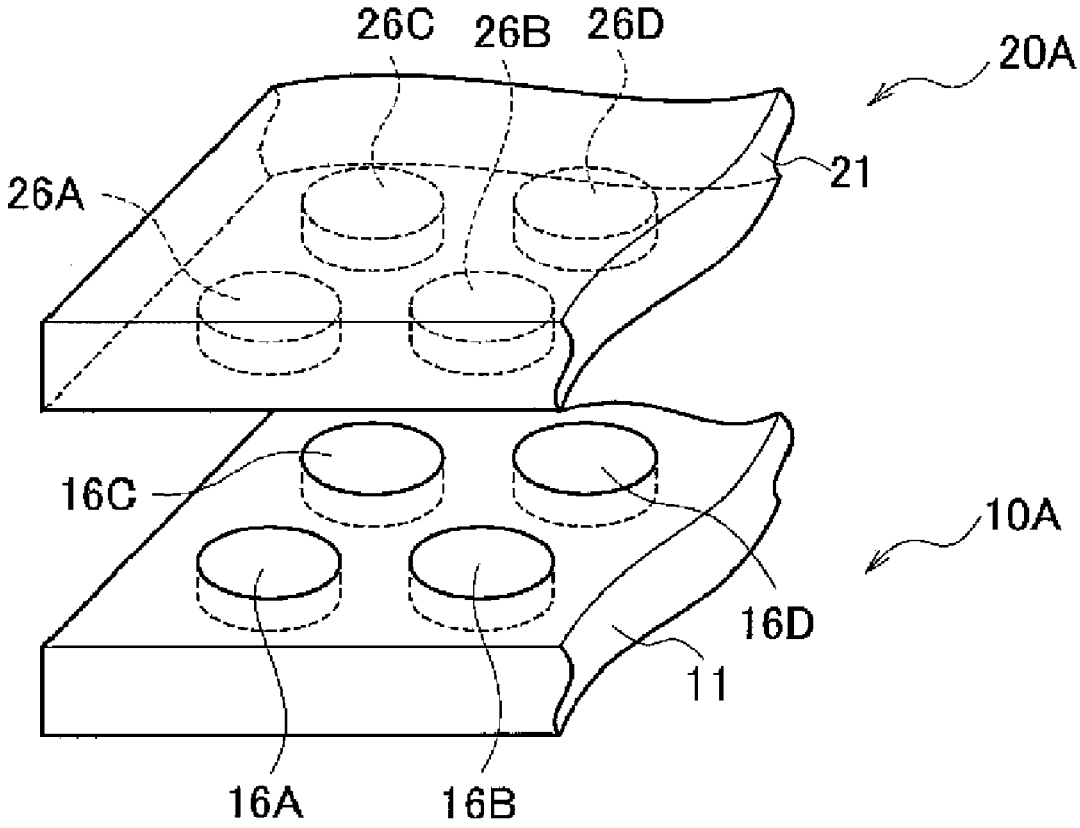
FIG. 10 shows an example of the plane schematic view of the minute connector in accordance with another embodiment of the present invention.

In the embodiments of the present invention, the first contact 16 and the second contact 26 extend from the first end to the second end of the first substrate 11 and the second substrate 21. However, the shapes of the first contact 16 and the second contact 26 are not restricted. A plurality of first contacts and a plurality of second contacts with circular or rectangular shapes are allowed to be scattered on the first substrate and the second substrate respectively. For example, the first connecting member 10A is equipped with a plurality of circular first contacts 16A, 16B, 16C and 16D scattered on the surface of the first substrate 11, as it is shown in FIG. 10. The second connecting member 20A is equipped with a plurality of circular second contacts 26A, 26B, 26C and 26D scattered on the surface of the second substrate 12 corresponding to the first contacts 16A, 16B, 16C and 16D respectively. The plurality of second contacts 26A, 26B, 26C and 26D correspond to the plurality of first contacts 16A, 16B, 16C and 16D respectively.

In this way, it is clear that various embodiments not described above are also within the scope of the present invention. Therefore, the technical scope of the present invention is to be determined only by the specified inventional items related to the claims appropriate to the explanations mentioned above.

The present invention can be applied to minute connectors with fine contact structure.

What is claimed is:

1. A minute connector for connecting between an insulative first substrate and an insulative second substrate, the insulative first substrate being provided with a plurality of first depressed portions depressed with respect to a surface of the first substrate, at each bottom surface of which a first conductive portion is disposed, the insulative second substrate being provided with a plurality of second depressed portions depressed with respect to a surface of the second substrate, at each bottom surface of which a second conductive portion is disposed, the minute connector comprising:

a first connecting member having a plurality of first contacts corresponding to the plurality of first depressed portions, the first contacts comprising a plurality of first carbon nanotube bundles respectively connected to the first conductive portions at first ends thereof and protruding from the surface of the first substrate at second ends thereof; and a second connecting member having a plurality of second contacts corresponding to the plurality of second depressed portions, the second contacts comprising a plurality of second carbon nanotube bundles respectively connected to the second conductive portions at first ends thereof;

wherein the second ends of the plurality of first carbon nanotubes are inserted between second ends of the plurality of second carbon nanotubes so as to contact with each other in an overlapping manner when the surface of the first substrate contacts the surface of the second substrate, whereby the plurality of first contacts each contact a corresponding one of the plurality of second contacts.

2. The minute connector according to claim 1, wherein the second ends of the plurality of second carbon nanotubes are each positioned at a level below a surface of the second substrate.

3. The minute connector according to claim 1, wherein each of the plurality of first contacts extends from a first end of the first substrate surface to a second end thereof; each of the plurality of second contacts extends from a first end of a surface of the second substrate to a second end thereof; and after bringing the first end of the first substrate into contact with the second end of the second substrate, the first substrate is slid relative to the second substrate from the second end of the second substrate to the first end thereof whereby the plurality of first contacts each contact a corresponding one of the plurality of second contacts.

4. The minute connector according to claim 3, wherein at least one of the first and second substrates includes a guide parallel to an extending direction of the plurality of first contacts so that the first substrate is allowed to slide while the plurality of first contacts are each in contact with the corresponding one of the plurality of second contacts.

5. The minute connector according to claim 3, wherein a friction coefficient between the surfaces of the first and second substrates is 0.5 or less.

6. The minute connector according to claim 3, wherein a width of each of the plurality of first contacts at the first end of the surface of the first substrate is smaller than that of a corresponding one of the plurality of second contacts at the first end of the surface of the second substrate.

7. The minute connector according to claim 1, wherein the plurality of first contacts are scattered on the first substrate, and the plurality of second contacts are scattered on the second substrate.

8. The minute connector according to claim 1, wherein the plurality of first contacts each have a width of 0.1 mm or less and are arranged with a pitch of 0.2 mm or less.

9. A minute connector for connecting between an insulative first substrate and an insulative second substrate, the insulative first substrate being provided with a plurality of first depressed portions depressed with respect to a surface of the first substrate, at each bottom surface of which a first conductive portion is disposed, the insulative second substrate being provided with a plurality of second depressed portions depressed with respect to a surface of the second substrate, at each bottom surface of which a second conductive portion is disposed, the minute connector comprising:

a first connecting member having a plurality of first contacts corresponding to the plurality of first depressed portions, the first contacts comprising a plurality of first carbon nanotube bundles respectively connected to the first conductive portions at first ends thereof and protruding from the surface of the first substrate at second ends thereof; and a second connecting member having a plurality of second contacts corresponding to the plurality of second depressed portions, the second contacts comprising a plurality of second carbon nanotube bundles respectively connected to the second conductive portions at first ends thereof;

wherein the second ends of the plurality of first carbon nanotubes are inserted between second ends of the plurality of second carbon nanotubes so as to contact with each other in an overlapping manner when the surface of the first substrate contacts the surface of the second substrate, whereby the plurality of first contacts each contact a corresponding one of the plurality of second contacts; and wherein an area density of the plurality of first carbon nanotubes differs from that of the plurality of second carbon nanotubes, and the second ends of either the plurality of first carbon nanotubes or the plurality of second carbon nanotubes with a higher area density are inserted into gaps between the second ends of the other carbon nanotubes with a lower area density so that the carbon nanotubes with the lower area density overlap with portions of the carbon nanotubes with the higher area density whereby the plurality of first contacts each contact a corresponding one of the plurality of second contacts.

* * * * *